United States Patent [19]

Brunner

[11] Patent Number: 4,739,829

[45] Date of Patent: Apr. 26, 1988

[54] WIRELINE OPERATED OIL WELL DUMP BAILER

[76] Inventor: Travis J. Brunner, P.O. Box 802, Houma, La. 70361-0802

[21] Appl. No.: 940,597

[22] Filed: Dec. 11, 1986

[51] Int. Cl.[4] ..... E21B 33/132

[52] U.S. Cl. ..... 166/63; 166/169; 166/286

[58] Field of Search ..... 166/63, 65.1, 286, 164, 166/169, 168, 162, 110

[56] References Cited

U.S. PATENT DOCUMENTS

| | | | |
|---|---|---|---|
| 2,526,021 | 10/1950 | Fultz | 166/169 |
| 2,696,258 | 12/1954 | Greene | 166/286 X |
| 2,696,259 | 12/1954 | Greene | 166/63 |
| 2,707,998 | 5/1955 | Baker et al. | 166/63 |
| 2,725,940 | 12/1955 | Shidell et al. | 166/286 X |
| 3,064,733 | 11/1962 | Bourne, Jr. | 166/55 |
| 3,187,813 | 6/1965 | Greene, Jr. | 166/286 X |
| 3,379,251 | 4/1968 | Bohn | 166/286 |
| 4,180,131 | 12/1979 | Chammas | 166/63 X |
| 4,512,401 | 4/1985 | Bodine | 166/286 X |

*Primary Examiner*—Stephen J. Novosad

*Attorney, Agent, or Firm*—Pravel, Gambrell, Hewitt, Kimball & Kreiger

[57] ABSTRACT

An improved wireline operated oil well dump bailer includes an elongated tool body having a longitudinal bore that extends through the tool body, the bore including a chamber section for carrying cement. A port through the tool body provides fluid communication between the tool bore and the oil well bore. A piston is slidably movable within the tool body between a first position in which the piston seals the port and a second position in which the piston is spaced from the port so that well bore fluid pressure can enter the tool body through the port and communicate with the piston. A trigger carried by the tool body, preferably in the form of an explosive charge which can be activated using the wireline moves the piston away from the first position to the second position so that the well fluid pressure enters the bore and powers the piston to dispense cement from the cement carrying chamber section. A dispensing outlet allows the cement to enter the well bore from the chamber responsive to pressure applied by the piston.

15 Claims, 5 Drawing Sheets

WIRELINE OPERATED OIL WELL DUMP BAILER

BACKGROUND OF THE INVENTION

The present invention relates to oil well downhole tools, and more particularly to an improved oil well dump bailer which is, for example, wireline operable and wherein a movable valve member is mounted within the tool body, the member initially covering a port that communicates with the well bore and, upon triggering of the device, shifts to expose the port so that well bore fluid pressure can enter the tool bore and drive the valve member to its full downward dispensing position.

It is well-known in the oil well drilling and production arts to use cement for various well operations such as, for example, to seal off a certain formation below a production packer so that other producing zones can be perforated. Typically, the dispensing of cement into the well bore is done using a device known in the industry as a "dump bailer." Dump bailers are typically gravity operated, using a very large weight which falls under the force of gravity to dispense any contained cement into the bore. The problem with these types of device is that they often fail to fully dispense the cement product as desired requiring multiple trips and additional expense to the well operation. It is to this problem that the present invention is directed.

The present invention provides an improvement over prior art type dump bailers by providing a dump bailer which uses well bore pressure to move a piston member, (preferably a piston) which fully dispenses the cement product from the well bore. The use of well bore pressure as described herein is an improvement over prior art type dump bailers which rely primarily upon gravity to pull a piston or dispensing member downwardly, or relies upon gravity to pull the cement from the tool body.

Several dump bailers have been patented. For example, U.S. Pat. No. 2,696,258 issued Dec. 7, 1954 to H. M. Green is entitled "Oil Well Cementing Packer." That device discloses a cementing packer wherein a charge is exploded to drive the cement from the bailer. The Green device uses a vertically elongated container with a body of cement contained in the container. A gas generated charge displaces the cement through a lower outlet in the container into the well bore. The device is further characterized by a bore sealing mechanism which is adapted to expand by cement displacing gases to plug the well bore above the zone being cemented, and thus seal the bore against upward dissipation of the force of the gases.

U.S. Pat. No. 2,591,807 issued to H. M. Green on Apr. 8, 1952 and entitled "Oil Well Cementing." The U.S. Pat. No. 2,591,807 discloses an apparatus for depositing cement in a zone within a well bore. The apparatus further includes a vertically elongated container to be lowered into the well bore zone and containing a body of cement, a relatively high velocity explosive charge in the lower portion of the container and serving upon ignition to cavitate the well bore at the zone. A relatively lower velocity explosive charge in the container above the body of cement serves upon ignition to force cement downwardly and outwardly into the cavity and a fuse for igniting the charges extends first to the high velocity charge and then to the lower velocity charge so as to ignite the charges in that order.

U.S. Pat. No. 3,187,813 entitled "Apparatus for Depositing Cement or the Like in a Well" issued June 8, 1965 to H. M. Green, Jr. The U.S. Pat. No. 3,187,813 provides a tool assembly to be lowered into a well on a flexible line and includes a container having a massive cementitious material therein. An opening is provided at the lower portion of the container which can be opened while in the well and thereby allow cementitious material to flow downwardly from the container and into the well by gravity. The assembly is constructed to avoid the application of the cementitious material with any other displacing forces other than gravity during the downward flow so that the cementitious material after leaving the container may seek its own level in the well by gravity.

U.S. Pat. No. 3,208,521 entitled "Recompletion of Well" issued on Sept. 28, 1965 to W. E. Holland et al. The Holland patent discloses a method of forming a plug in a well pipe including the steps of anchoring a support member at a given level in the pipe, depositing a quantity of liquid cementitious mixture on the support member, inserting a conductive metal rod in the cementitious mixture so that the rod extends substantially through the cementitious mixture and is substantially centrally located on the longitudinal axis of the well pipe. After the cementitious mixture has hardened for at least a period of two hours, an electrical direct current is passed from the well pipe to the rod through the hardened cementitious mixture until there has passed at least fifty coulombs of electricity per square inch of contact between the pipe and the cementitious mixture.

A "Method for Cementing Well" issued as U.S. Pat. No. 2,689,008 on Sept. 14, 1954 to T. O. Allen et al. The Allen patent provides a method for cementing a well having a perforated casing therein which comprises locating a body of hydraulic cementitious material in the perforated casing in the region of and adjacent the perforations and locating a high explosive detonating charge in the body of the cementitious material. The charge is discharged and at least a portion of the cementitious material is forced through the perforations thereby dehydrating and setting the portions of cementitious material to seal the perforations.

A "Dump Bailer for Well" issued as U.S. Pat. No. 2,725,940 to G. A. Shidell et al. on Dec. 6, 1955. The Shidell patent discloses a dump bailer for wells including a tubular body, a closure for its upper end including an attachment to a lowering cable, a filler opening in the wall of the body adjacent the closure, a tubular sleeve coaxially connected to the lower end of the body, a removable plug closing lower into the sleeve, and the downwardly facing annular shoulder in the bore of the sleeve axially spaced from the plug, the sleeve having a discharge passage through the wall thereof between the shoulder and the plug, a tubular frangible liner is coaxially positioned in the bore of the sleeve opposite the passage and having one end abutting the shoulder and the other end abutting the plug, an annular resilient seal is disposed to form a fluid type seal between the liner and the wall of the sleeve at points above and below the passage thereby to close off the passage. An electrically fired explosive charge positioned in the bore of the liner is provided and the cable provides a means for firing the charge so as to shatter the liner and open the passage.

U.S. Pat. No. 1,393,311 issued to H. C. Pendelton on Oct. 11, 1921 for a "Method and Means for Facilitating Sealing Deep Wells." The Pendelton device provides a means for facilitating the sealing of a well against water and includes a frangible container adapted to be lowered which is charged with cement into a well and then disrupted, the container having on its leading end a centering device to guide its movement clear of the well, hold surface to prevent premature fracture of the shell.

U.S. Pat. No. 3,379,251 entitled "Dump Bailer" issued on Apr. 23, 1968 to F. O. Bohn. The Bohn patent discloses a dump bailer for depositing material in a well bore. The apparatus includes a reservoir section formed of a length of flexible tubing, a bottom plug closing one end of the reservoir section, a supporting head having a lower portion to which the upper end of the reservoir section is attached, and an upper portion mechanically attaching a wireline cable for positioning the dump bailer in the well bore, and means to fill the reservoir with a material to be deposited. A squeegy is formed of two spaced apart rollers, attached together by crossbars and secured to the upper end of the flexible tubing forming the reservoir section. A pair of pivotally spring loaded fingers are attached to the crossbars for engaging the walls of the bore hole upon any upward movement of the dump bailer so that the squeegy remain stationary and then as the dump bailer is moved upward, the pressure on the bottom of the reservoir is increased ejecting the bottom plug and then positively depositing the material in the reservoir.

An "Apparatus and Method for Completing Wells" issued as U.S. Pat. No. 3,064,733, on Nov. 20, 1962 to H. A. Bourne, Jr. The Bourne patent discloses an attachment for a gun used in perforating wells, comprising a housing attachable to the lower end of the gun, the housing having a cylindrical chamber therein and a plurality of circumferentially spaced outlet ports at the upper end of the chamber. A piston is reciprocally disposed in the chamber, and an energy source in the housing is arranged to raise the piston through the chamber. A hydraulically actuated packer on the housing below the outlet ports is in communication with the chamber and a firing mechanism for the gun in the housing is arranged to be actuated by the piston as the piston reaches the upper end of the chamber.

U.S. Pat. No. 3,318,393 entitled "Formation Treatment" issued May 9, 1967 to T. D. Brown. The Brown patent describes a wireline apparatus for treating a permeable earth formation zone containing a formation fluid under pressure and traversed by a case bore hole containing a column of fluid extending upwardly of the zone providing a hydrostatic pressure environment within the casing greater than the pressure of formation fluid. The apparatus includes a body adapted to be lowered within the bore hole by means of a wireline, a perforator including explosive material disposed on the body for perforating the casing along a predetermined axis to establish fluid communication with the formation therebeyond when the explosive material is fired, a compartment in the body providing a volume of low pressure gas of a size to contain any gases evolving from the explosive material when fired at a pressure less than the pressure of the formation fluid, a sealing mechanism on the body for isolating the fluid communication from the hydrostatic pressure environment of the bore hole by sealing off an isolated area of the casing wall when urged thereagainst.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF A PREFERRED EMBODIMENT

Figure 1:
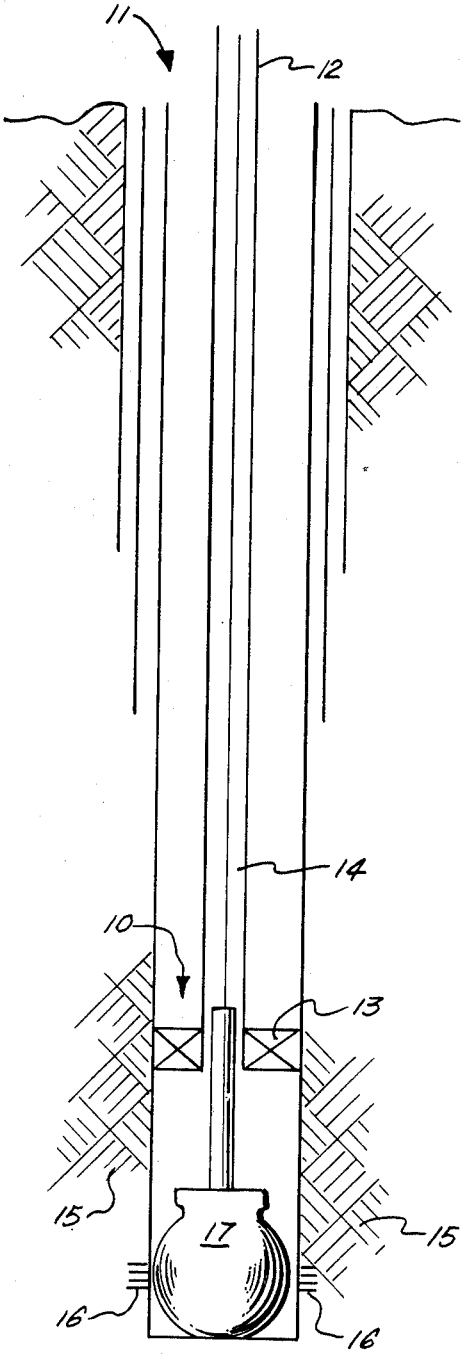
FIG. 1 is a schematic, elevational view of the preferred embodiment of the apparatus of the present invention illustrating placement of the tool below a production packer and adjacent a producing formation.
Figure 2:
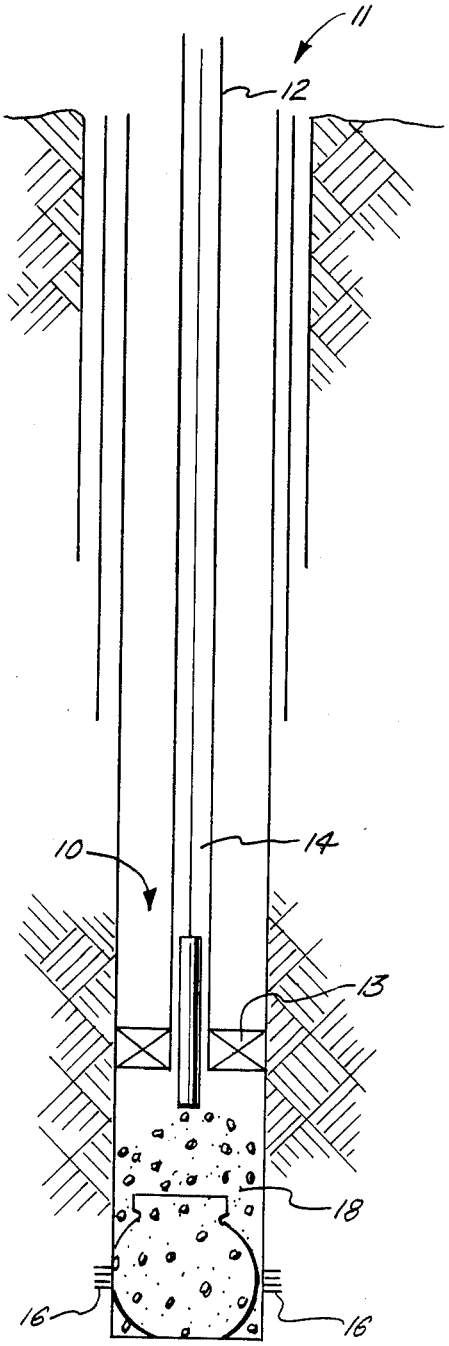
FIG. 2 is another sectional, elevational view of the preferred embodiment of the apparatus of the present invention shown discharging cement below a production packer.

FIGS. 1 and 2 show schematically operation of the preferred embodiment of the apparatus of the present invention designated generally by the numeral 10 in the drawings. In FIG. 1, there can be seen a well head area 11 of an oil well and production tubing 12 as well as a production packer 13, and a wireline 14 supporting the tool 10. The illustrations of FIGS. 1 and 2 show a completed well with a through tubing type operation. Oil producing formation 15 surrounds the well, while perforations 16 have been sealed off with packer 17. In FIG. 2, the tool 10 has discharged a mass of cement 18 to close the perforation 16 and thus the well at that particular location below packer 13 so that the well is closed at least with respect to the perforations 16.

Figure 3A:
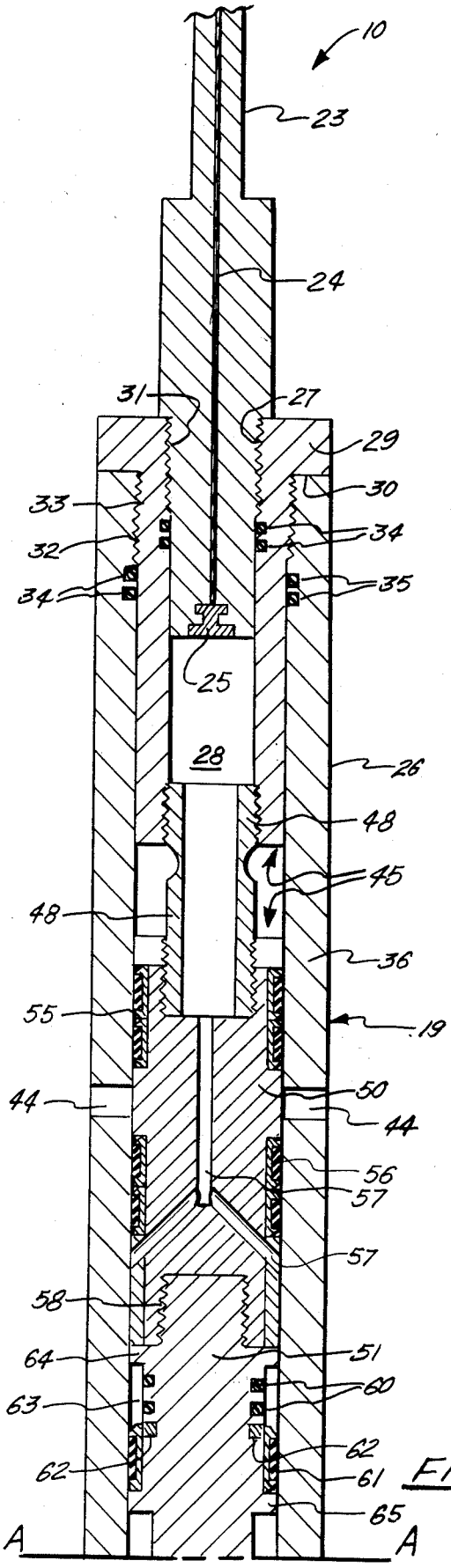
FIGS. 3A–3B are partial elevational and sectional views of the preferred embodiment of the apparatus of the present invention including the upper and central portions of the tool respectively, connectable at match line A—A.
Figure 3B:
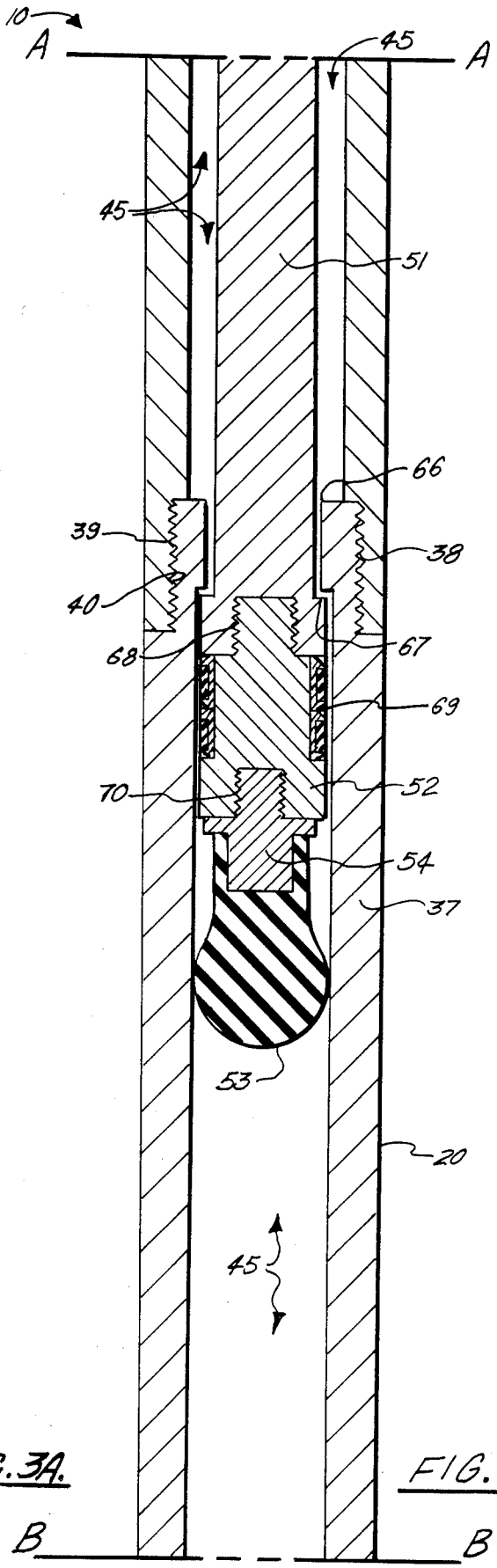

In FIGS. 3A–3B and 4A–4B, the apparatus 10 of the present invention is shown in a sectional, elevational view. FIGS. 3A–3B illustrate the top and central portions of the tool 10 designated by the numerals 19, 20, and in FIG. 4A the bottom portion of the tool is illustrated in a first embodiment (FIG. 4A) designated by the numeral 21, and a second embodiment (FIG. 4B) is designated by the numeral 22. The tool 10 is operated by means of a conventional wireline designated generally as 23 in FIG. 1. Wireline adapter 23 includes an internal wire 24 which can electrically activate a trigger in the form of an explosive cap 25 placed within the tool body 26. Wireline adapter 23 attaches at assembly nut 29 to tool body 26. An explosive charge 28 is carried in a compartment below cap 25 so that when the wireline 23 is activated, an electrical signal is transmitted through wire 24 to cap 25 to thereby detonate the explosive charge 28 and shear sleeve 48. The passageway 57 allows the fluid communication between the compartment below cap 25 in the two below seals 56 if desired (FIGS. 3–5).

Tool body 26 includes upper assembly nut 29 having an external annular shoulder 30 with internal 31 and external 32 threaded portions that mate respectively with a threaded section of wireline adapter 23 at threaded connection 27 and with the upper portion of tool body 26 at threaded connection 33. O-rings 34 perfect a seal between adapter 29 and wireline adapter 23, while O-rings 35 perfect a seal between adapter 29 and tool body 26. Tool body 26 includes upper 36 and middle 37 sections which are threadably assembled at threaded connection 38 by means of threaded portions 39, 40, respectively of upper section 36 and middle section 37 of tool body 26. A lowermost 41 section of tool body 26 includes a bulbous or hemispherical tip 42.

A plurality of radially or transversely extending ports 44 extend between the bore 45 of the tool body and externally thereof into the well bore. At the lowermost end portion of the tool there are provided a plurality of diagonally extending ports 46 which similarly extend between the bore 45 of the tool body and the exterior thereof. A longitudinal central channel 47 extends between the central 20 portion of tool body 26 and the lower 21 portion thereof.

The apparatus of the present invention is activated by means of introducing an electrical signal through wire 24 to explosive cap 25 so that explosive charge 28 can be detonated. When the detonation takes place, collet 48 is broken into two pieces at weakened section 49 which can be, for example, an annular section of collet 48 of reduced thickness. A piston is provided which is slidably movable within tool body 26 inside the bore 45 thereof. The piston includes an upper piston section 50, connecting rod section 51, and lower piston section 52. Wiper 53 is a rubber-like wiper disposed at the lower end portion of the piston member and connected to the lower piston section 52 with adapter 54. Upper piston section includes spaced apart piston seals 55, 56 while lower piston section 52 has seals 69. An annular shoulder 64 provided at the upper end portion of connecting rod 51 spaced from a second lower annular shoulder 65 so that an annular space 63 is defined therebetween the annular shoulder 64, 65. Space 63 is occupied by an annular composite seal ring 61, as shown in FIG. 3A. Seal 61 is preferably a composite metal/rubber seal which is commercially available and forms a seal between lock ring 62 and tool body 19. After successful firing of explosive charge 28 and a downward movement of the piston, lock ring 62 holds seal 61 in an upper position over O-ring seals 60.

An annular shoulder 66 provided at the upper end portion of tool body central portion 20 cooperates with annular shoulder 67 of connecting rod 51 to define a stop which limits upward movement of the piston assembly when shoulders 66 and 67 abut. Further, the bore 45 is of a smaller diameter below shoulder 66 and of a larger diameter above shoulder 66. Thus, the cross-sectional area of the piston at upper piston section 50 is larger than the piston cross-sectional area at lower piston section 52. This difference in cross-sectional area causes the piston to move downwardly when well annular pressure enters bore 45 via port 44.

Adapter 52 connects to connecting rod 51 at threaded section 68, while wiper 53 connects to adapter 52 at threaded connection 70. Wiper 53 includes a metallic section 54 which forms the threaded connection 70 with adapter 52.

Figure 4A:
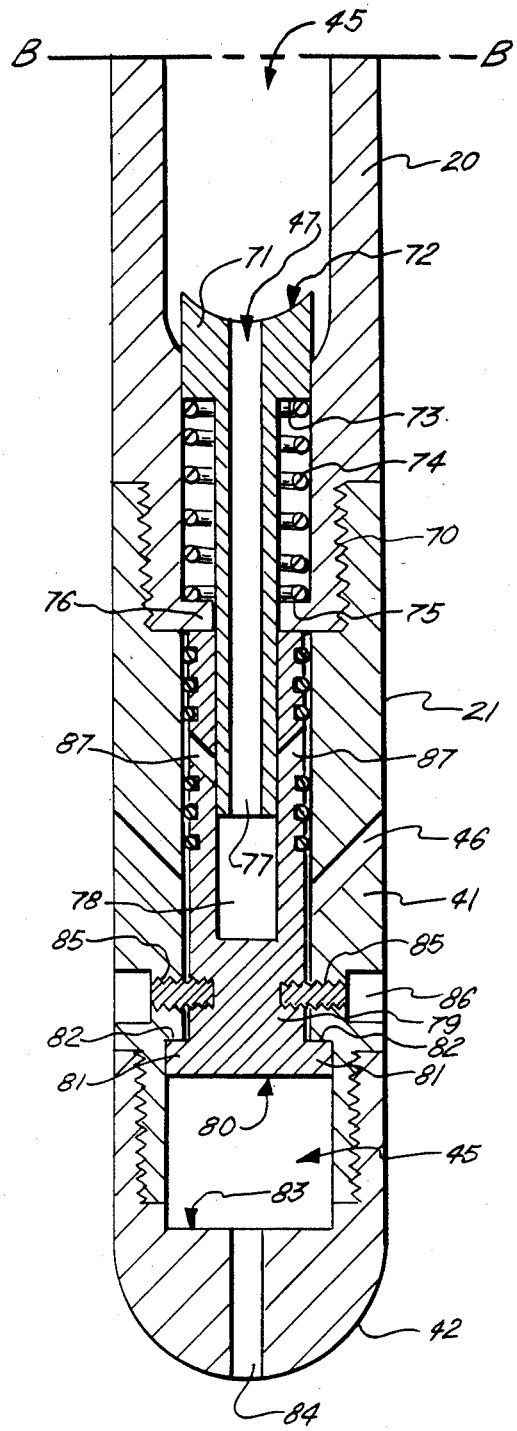
FIG. 4A is a partial, sectional elevational view of the preferred embodiment of the apparatus of the present invention illustrating the lower end portion of the tool, and the line B—B being a match line that matches with B—B of FIG. 3B.
Figure 4B:
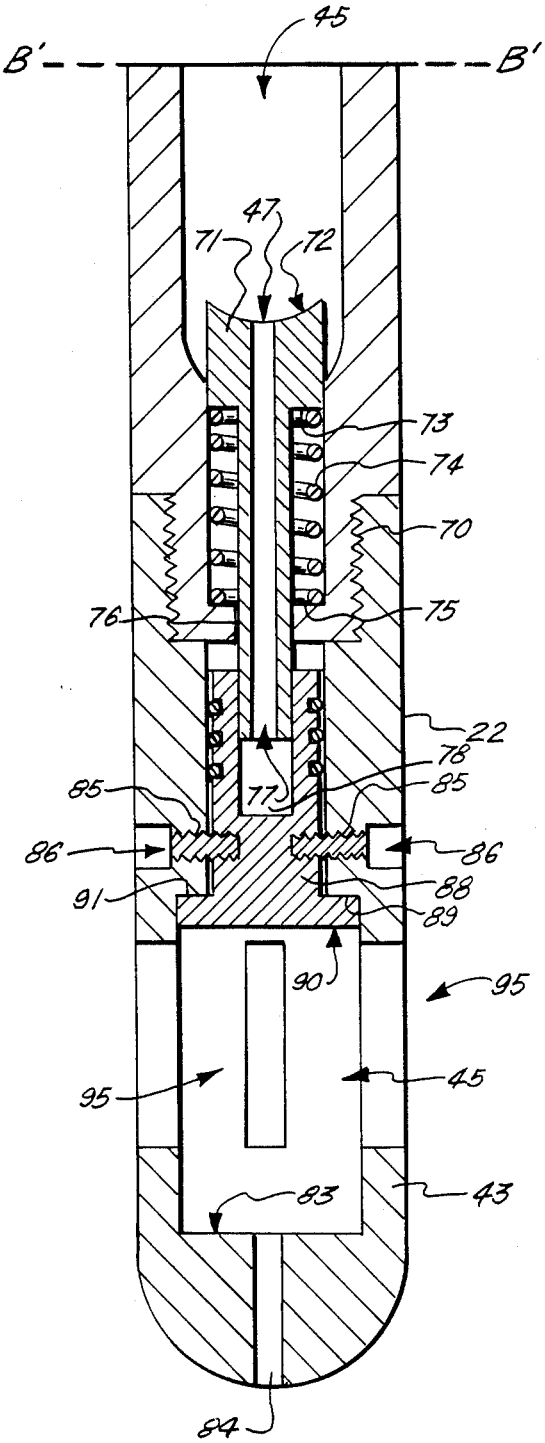
FIG. 4B is a partial elevational and sectional view of a second embodiment of the apparatus of the present invention illustrating the lowermost end portion of the tool, and wherein the line B—B is a match line that matches with line B—B of FIG. 3B.
Figure 5:
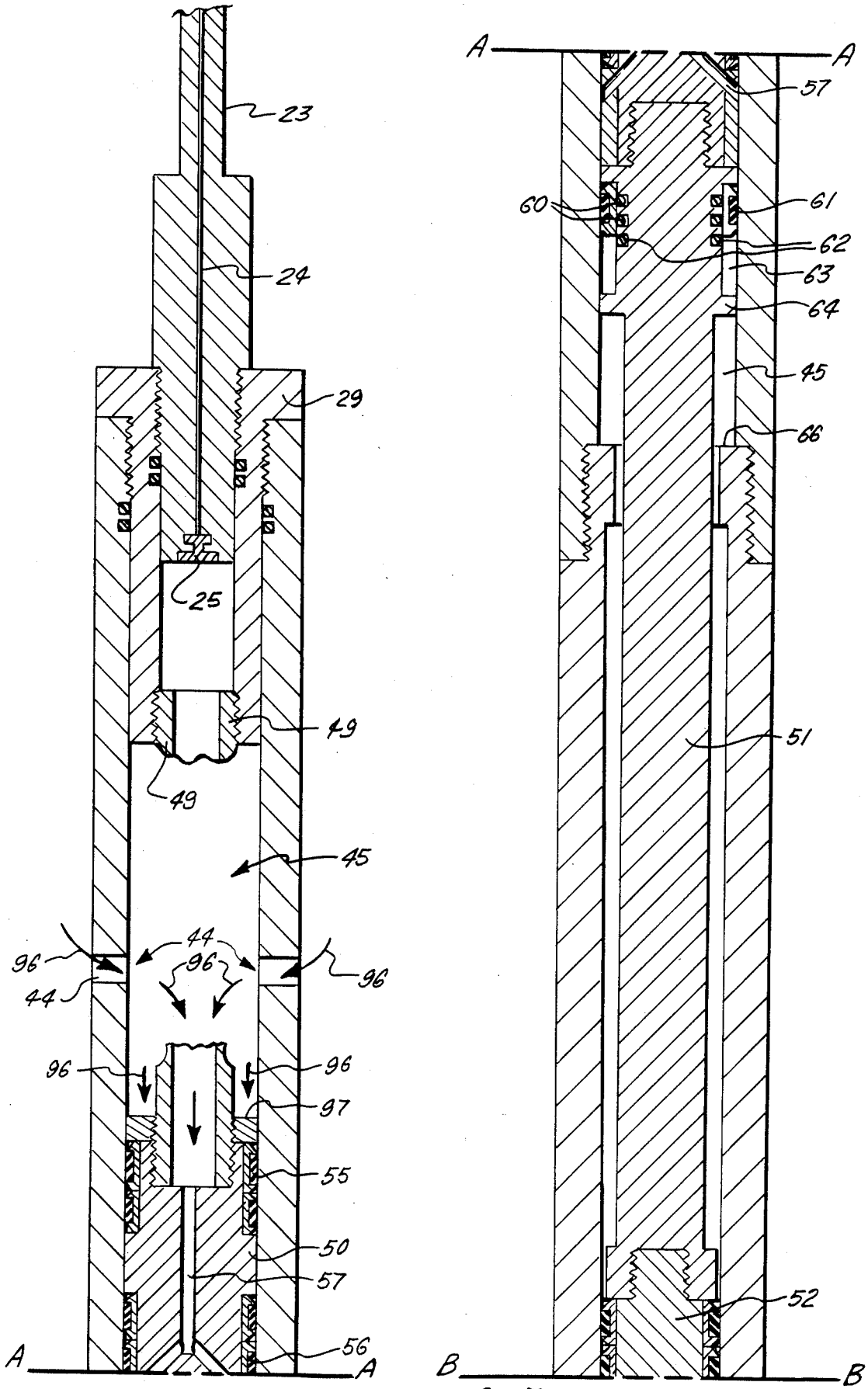
FIG. 5 is a partial elevational and sectional view of the preferred embodiment of the apparatus of the present invention including the upper and central portions of the tool after the triggering mechanism has been actuated, connectable at match lines A—A.

FIGS. 4A–4B show two embodiments of the present invention in that the lowermost end portion of the tool 21 and 22 respectively are two embodiments shown in FIGS. 4A and 4B respectively. In FIG. 4A, there is seen a dispenser 71 having a concave end portion 72 receptive of the wiper 53. Dispenser 71 includes a central longitudinal channel 47 for conveying a cementitious material to dispensing orifice end portion 77 of dispenser 71. The lowermost end portion of tool body central section 20 includes an annular shoulder 75. Dispenser 71 similarly provides an annular shoulder 73 with spring 74 being disposed between shoulder 73, 75 (FIG. 4A). An opening 76 in the lower end portion of tool body central portion 20 allows dispenser 71 to pass therethrough and enter the lower 21 section of the tool body. A sleeve 79 includes an internal bore 78 that is receptive of the tip 77 of dispenser 71 as shown in the drawings. The sleeve 79 includes a flat end portion 80 that includes an annular shoulder 81. The annular shoulder 81 cooperates with a similarly configured annular shoulder 82 of the lower portion 21 of the tool body. Hemispherical tip section 42 of the tool body includes the lowermost end portion of the bore 45 which is shaped in cross-section with a similar shape to the flat surface 80 of sleeve 79, both preferably being round. The lowermost end of bore 45 is thus defined by flat surface 83 having a circular cross-section which is corresponding to that end portion 80 of sleeve 79. Bleed port 84 allows fluid to dispense from the lowermost end portion of bore 45 into the well bore so that sleeve 79 can move fully downwardly until surface 80 abuts surface 83. A plurality of shear pins 85 are used to secure sleeve 79 in an uppermost position as shown in FIG. 4A with access ports 86, for example, allowing the shear pins 85 to be placed in the position shown in FIG. 4A. Sleeve 79 includes a plurality of diagonally extending ports 87 which communicate with ports 46 when the tool has been fired as will be described more fully hereinafter with respect to FIGS. 6A and 6B.

In the embodiment of FIG. 4B, the sleeve 88 is similarly configured to that of FIG. 4A but somewhat shorter. Annular shoulder 89 is provided at the lower end portion of sleeve 88 and sleeve 88 includes a flat circular end portion 90 which has a similar cross-sectional configuration to the flat end portion 89 of the tool body and of bore 45. The lower section 22 of the tool body likewise provides a corresponding annular shoulder 91 so that shoulder 89 can abut and register against shoulder 91 as shown in FIG. 4B. This defines the uppermost position of the sleeve 88 prior to firing of the tool. A plurality of radially spaced longitudinal slots 95 allow cementitious material to be dispensed into the well bore (see FIG. 6B) when the tool is fired.

Figure 6A:
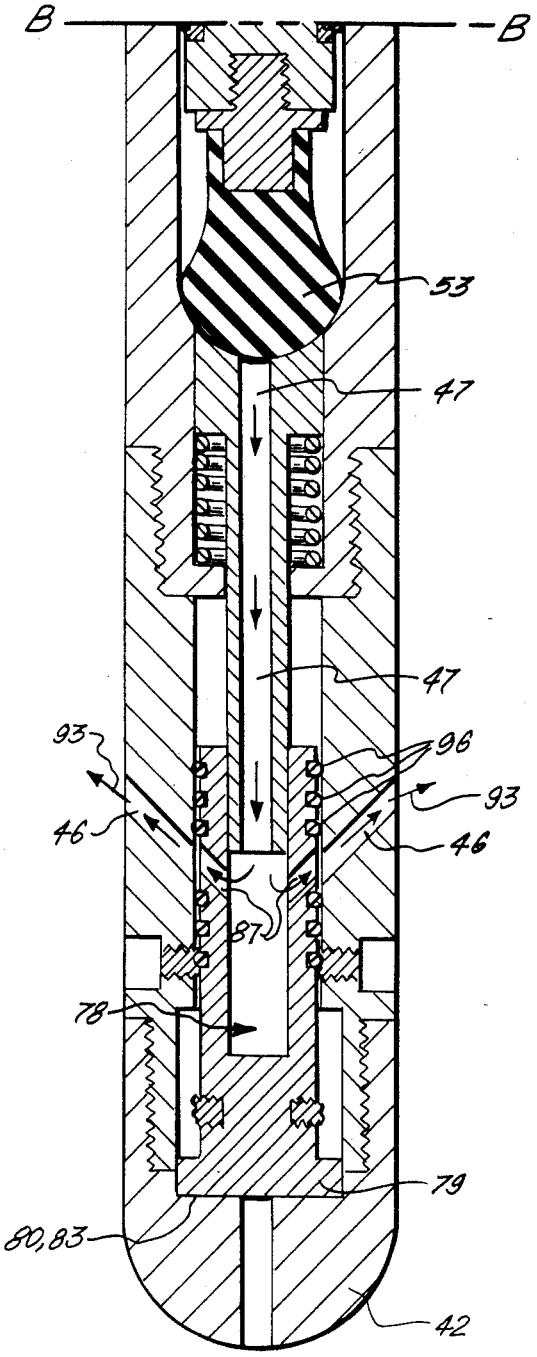
FIG. 6A is a partial sectional and elevational view of the preferred embodiment of the apparatus of the present invention illustrating the lower end portion of the tool after the triggering mechanism has been actuated and the lines B—B being a match lines that meets with B—B of FIG. 1.
Figure 6B:
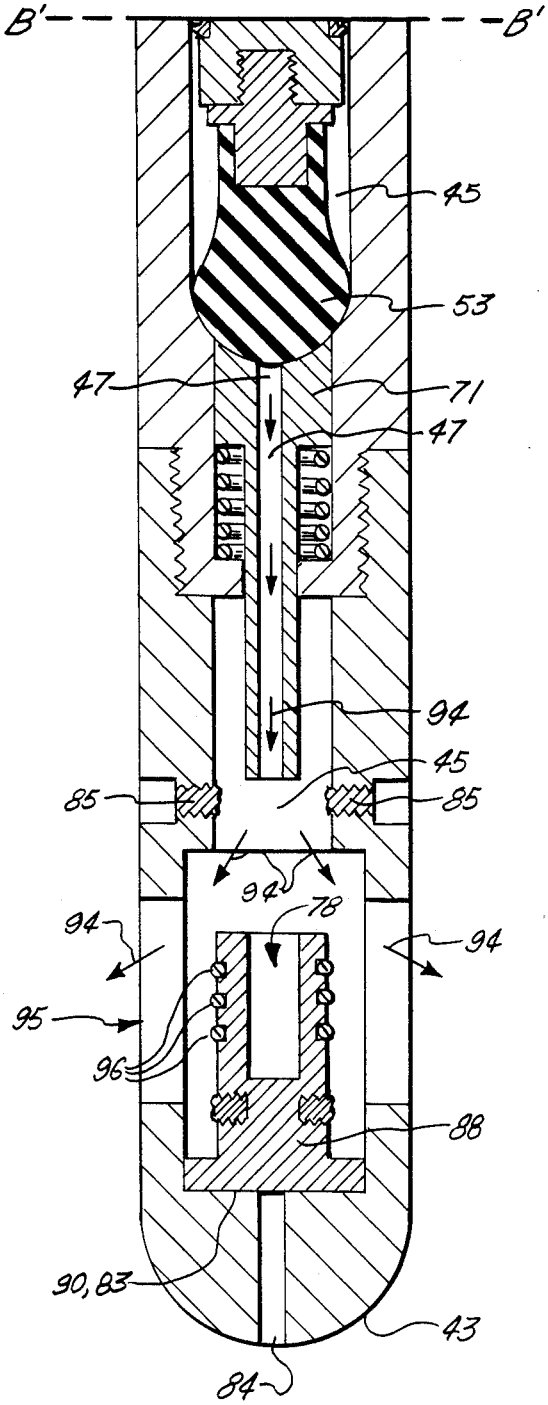
FIG. 6B is a partial sectional and elevational view of a second embodiment of the apparatus of the present invention illustrating the lowermost end portion of the tool after the triggering mechanism has been actuated, and wherein the line B prime-B prime is a match line that mates with B—B of FIG. 1.

FIGS. 5, and 6A–6B illustrate the position of the tool and of the piston after detonation of the explosive charge. In FIG. 5, the collet 48 has been broken at weakened section 49 and the piston has moved downwardly exposing ports 44 so that well bore fluid pressure can enter the tool bore 45 as illustrated by the arrows 96 in FIG. 5. In this position, fluid well bore pressure can act as shown by arrows 96 upon the upper end portion of piston upper section 50 and specifically upon the surface 97 as shown in FIG. 5.

In FIG. 6A, the wiper 53 has moved downwardly dispensing cementitious material contained within bore 45 and below the wiper 53 through channel 47 and laterally into the well bore through ports 87 and 46. In FIG. 6A, the well bore fluid has driven the piston fully downwardly and has caused the wiper to contact dispenser 71 forcing it to a downward position and further the force of the well bore fluid has moved cementitious material through the channel 47 and into the bore 78 of sleeve 79. This drives the sleeve 79 downwardly shearing the pins 85 until the surface 80 abuts the surface 83 as shown in FIG. 6A. When the sleeve 79 is thus driven downwardly, the diagonal ports 87 of sleeve 79 align with the diagonal ports 46 so that cementitious material can exit as shown by the arrows 93 of FIG. 6A. Downward travel equalizes pressure in the tool bore 45 with well bore hydrostatic pressure, and cementitious material is discharged through the ports 46 when internal pressure exceeds bottom hole hydrostatic plus the value of the shear pins.

In the embodiment of FIG. 6B, the piston has also moved downwardly as a unit and the wiper 53 abuts the dispenser 71 driving it downwardly and dispensing cementitious material contained in the bore 45 through channel 47. The cementitious material also enters bore 78 of sleeve 88 forcing it downwardly, shearing the pins 85 and moving the sleeve downwardly until the surface 90 contacts and registers against the surface 83 as shown in FIG. 6B. In this position, cementitious material can flow freely from channel 47 into the tool bore 45 and then laterally escapes through the longitudinal slots 95 into the well bore. Arrows 94 in FIG. 6B illustrate the flow of cementitious material from the tool bore 45 above dispenser 71, thence through the channel 47 and finally into the well bore by passing through the longitudinal slots 95. Each sleeve 79, 88 includes a plurality of O-rings 96 on its outer surface so that a seal is formed between the sleeve 79, 88 and its respective tool body section 21, 22.

The foregoing description of the invention is illustrative and explanatory thereof, and various changes in the size, shape and materials, as well as in the details of the illustrated construction may be made without departing from the spirit of the invention.

What is claimed as invention is:

1. A wireline operated oil well dump bailer comprising:

a. an elongated tool body;

b. upper connection means on the tool body for forming a connection between the tool body and the wireline;

c. a longitudinal tool bore extending through the tool body;

d. the bore including a chamber section for carrying cement;

e. port means through the tool body for providing fluid communication between the tool bore and the oil well;

f. moving means for displacing cement from the cement carrying chamber, including a member movably mounted within the tool body between a first position in which the member seals the port means, and a second position in which the member is spaced from the port means wherein well bore fluid pressure can enter the tool bore through the port means and communicate with the moving means;

g. triggering means carried by the tool body and actuable from the wellhead for moving the member away from the first position to the second position so that well bore fluid pressure enters the bore and powers the member to dispense cement from the cement carrying chamber section; and h. dispensing outlet means for discharging cement from the chamber into the well bore responsive to pressure applied by the moving means.

2. The wireline operated oil well dump bailer of claim 1 wherein the cement chamber is positioned generally below the moving means.

3. The wireline operated oil well dump bailer of claim 1 wherein the triggering means includes charge means for setting off an explosive charge.

4. The wireline operated oil well dump bailer of claim 3 further comprising breakable shear plug means for affixing the moving means with respect to the body, and the charge means is positioned within the bore above the shear plug means.

5. The wireline operated oil well dump bailer of claim 1 wherein the dispensing outlet includes one or more diagonal channels extending between the tool bore and the body outer surface.

6. The wireline operated oil well dump bailer of claim 1 wherein the moving means comprises an elongated mandrel having upper and lower spaced apart annular seals at its respective end portions.

7. The wireline operated oil well dump bailer of claim 1 further comprising stop means for defining the limit of travel of the moving means within the tool bore.

8. The wireline operated oil well dump bailer of claim 1 further comprising wiper means affixed to the lower end portion of the moving means for swabbing the cement chamber during a dispensing of cement therefrom.

9. The wireline operated oil well dump bailer of claim 1 wherein the dispensing outlet means includes a sleeve removably affixed to the tool bore below the cement chamber and having a sleeve bore that communicates with the tool bore, a sleeve port extending through the sleeve wall and a cement dispensing port in the tool body wall, an alignment of the sleeve port and cement dispensing ports allowing cement to flow from the tool bore to the well bore.

10. The wireline operated oil well dump bailer of claim 9 further comprising one or more shear pins for securing the sleeve with respect to the tool body.

11. The wireline operated oil well dump bailer of claim 7 wherein the stop means includes a shock absorber positioned within the tool bore to receive one end portion of the piston.

12. The wireline operated oil well dump bailer of claim 9 wherein the sleeve is normally secured by the shear pins in a position that misaligns the sleeve port and cement dispensing ports.

13. The wireline operated oil well dump bailer of claim 12 wherein the tool body has a first transverse face at the lower end portion of the bore and the sleeve has a second and corresponding transverse face which abuts the first face when the trigger means is activated, and such abuttment aligns the sleeve bore and cement dispensing bore.

14. The wireline operated oil well dump bailer of claim 11 wherein the shock absorber is spring loaded.

15. The wireline operated oil well dump bailer of claim 4 wherein the shear plug means is a hollow plug secured at its upper end portion to the tool body and at its lower end portion to the moving means.

* * * * *